United States Patent [19]

Williams

[11] Patent Number: 4,512,277

[45] Date of Patent: Apr. 23, 1985

[54] ADJUSTABLE CANOE PONTOONS

[76] Inventor: Donald F. Williams, 53 E. Lakewood Dr., Fenton, Mo. 63026

[21] Appl. No.: 571,340

[22] Filed: Jan. 16, 1984

Related U.S. Application Data

[63] Continuation of Ser. No. 369,513, Apr. 19, 1982, abandoned.

[51] Int. Cl.[3] ..... B63B 35/00

[52] U.S. Cl. ..... 114/364; 114/283; 114/123; 114/347; 248/231.6

[58] Field of Search ..... 114/347, 360, 364, 283, 114/123; 248/538, 518, 540, 231.6; 440/104, 105

[56] References Cited

U.S. PATENT DOCUMENTS

| | | | |
|---|---|---|---|
| 1,352,810 | 9/1920 | Hunt | 248/231.6 |
| 1,987,842 | 1/1935 | Sampson | 248/538 |
| 2,220,234 | 11/1940 | Hadaway | 248/538 |
| 2,869,812 | 1/1959 | Hamel | 114/364 |
| 3,233,257 | 2/1966 | Biehl | 114/347 |

FOREIGN PATENT DOCUMENTS

| | | | |
|---|---|---|---|
| 499627 | 2/1954 | Canada | 114/123 |

*Primary Examiner*—Trygve M. Blix
*Assistant Examiner*—Edwin L. Swinehart

[57] ABSTRACT

Adjustable clamp-on canoe pontoon with outrigger arms, adjustable in height for various depth canoes, having a two-piece clamping device for mounting to the top surface of the "T"-shaped gunwales of various canoes.

3 Claims, 4 Drawing Figures

ADJUSTABLE CANOE PONTOONS

This is a continuation of Ser. No. 369,513 filed Apr. 19, 1982, now abandoned.

This invention relates to a new and improved stabilizing device for canoes of various brands and sizes. The primary feature of the present invention is to provide outriggers, carried by the gunwales of the canoe, that are highly-buoyant and light in weight to help prevent overturning of the canoe, particularly for use on lakes and bays. The canoe becomes more versatile for fishing or hunting and safer when running with a boat motor. Movement in canoe is no longer hazardous and pontoons are not overly extended out from canoe.

An important feature of the present invention is the adjustable two-piece clamping device for mounting the pontoon to the top flat surface of a "T"-shaped gunwale of a canoe comprising first clamp adapted to engage the top and inboard bottom surface of said "T"-shaped gunwale lying flat across the top thereof and a second clamp adapted to engage the outboard bottom surface of said "T"-shaped gunwale and having a bolt and nut connecting said first and second clamp to the upper end of an outrigger arm for attachment to a pontoon, said nut and bolt providing an upper pivot point to allow said clamp to conform to the different shapes of various length canoes.

A further feature of the present invention is to provide adjustment in height of the pontoon because of the various depths of different size canoes. This feature also allows for adjustment to water level, which will provide canoe with additional load capacity when needed, such as bringing in a trophy on a hunting trip. This feature is accomplished by a two-piece adjustable height outrigger arm comprising an upper arm adapted to connect to a pivot point on top of the clamp and then extending vertically downward having adjustment holes before terminating, and a lower outrigger arm "L"-shaped having a hole toward the end of the upper vertical leg which lines up with and connects with nut and bolt to any one of the adjustment holes on the upper arm providing the adjustment in height, and the horizontal leg of the lower outrigger arm extends out passing through and securing the pontoon with a retainer attached to the end of arm.

Other features and advantages reside in the details of construction and operation as more fully hereinafter described and claimed, reference being had to the accompanying drawings forming part hereof, wherein like numerals refer to like parts throughout and in which:

Figure 1:
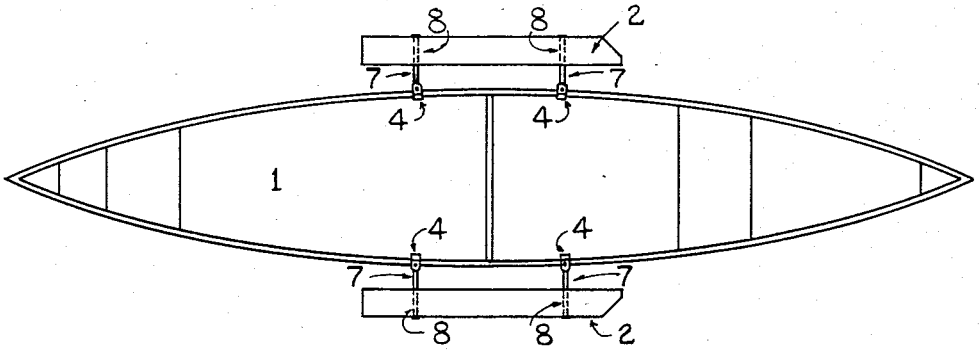
FIG. 1 is a plan view of a canoe with adjustable pontoons attached showing rotation of clamping device to contour of canoe from the pivot point on top of the angle clamp.
Figure 2:
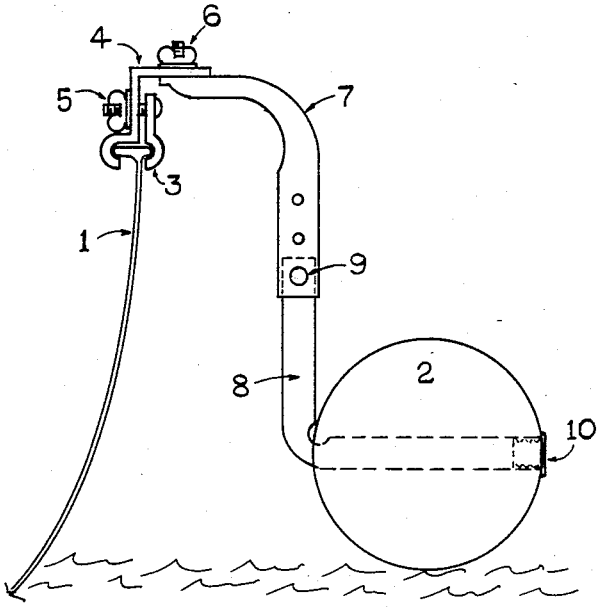
FIG. 2 is a fragmentary section thru canoe with an end view of the attached pontoon showing a two-piece clamping device mounted to the top flat surface of the "T"-shaped gunwale of the canoe.
Figure 3:
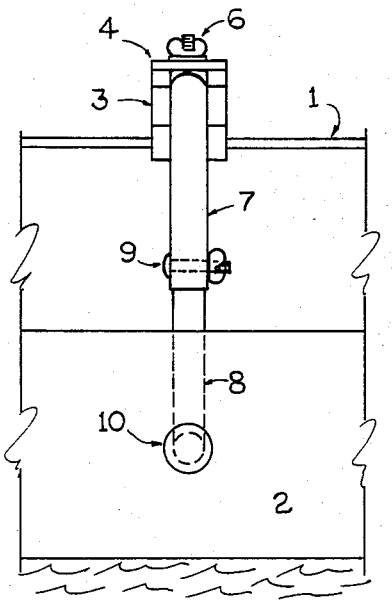
FIG. 3 is a fragmentary side elevation of canoe and attached pontoon.

The Item 1 represents any canoe with an aluminum gunwale of sufficient design to accept this device.

According to the invention, two pontoons 2 are secured to the gunwales of the canoe 1 by first clamp 3 and second angle clamp 4, with the use of carriage bolts, washers, and wing nuts 5.

Further, other carriage bolts, washers, and wing nuts 6 secure the upper arms 7 to the angle clamps 4. The lower arms 8 are adjustable to slip into the upper arms 7 and are held in place with bolts and wing nuts 9. Lower arms 8 pass through pontoons 2 and pontoons are held in place with a compressed fitting with flange 10.

Figure 4:
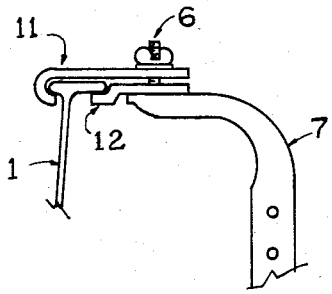
FIG. 4 is an end view of an alternate clamp for some canoes.

FIG. 4—First clamp 11 and second clamp 12 represent alternates to replace clamps 3 and 4 for some canoes.

The pontoons 2 are 54" long ×6" diameter polyethelene closed cell foam—Dow Ethafoam, or equal material. Size and shape of pontoons may vary with different material.

Upper and lower arms 7 and 8 are 18 gauge aluminum or steel tubing or plastic tubing formed to configuration shown.

Clamps 3, 4, 11, and 12, are molded plastic (Dupont Rynite or equal) or extruded aluminum alloy. Angle clamp 4, if made from plastic, may be molded with webs at each side of angle to provide added strength.

Fitting with flange 10 is made of plastic material to compress in end of tubing to secure pontoon 2.

What is claimed is:

1. An adjustable two-piece clamping device for mounting a pontoon to the top flat surface of a "T"-shaped gunwale of a canoe comprising a first clamp adapted to engage the top and inboard bottom surface of said "T"-shaped gunwale lying flat across the top thereof and a second clamp adapted to engage the outboard bottom surface of said "T"-shaped gunwale and having a bolt and nut connecting said first and second clamp to the upper end of an outrigger arm for attachment to a pontoon, said nut and bolt providing an upper pivot point to allow said clamp to conform to the different shapes of various length canoes.

2. An adjustable two-piece clamping device for mounting a pontoon to a canoe as defined in claim 1 wherein said outrigger arm is two- piece, adjustable in height comprising an upper arm adapted to connect to the pivot point on top of the clamp and then extending vertically downward having adjustment holes before terminating, and a lower outrigger arm "L"-shaped having a hole toward the end of the upper vertical leg which lines up with and connects with nut and bolt to any one of the adjustment holes on the upper arm providing the adjustment in height, and the horizontal leg of the lower outrigger arm extends out passing through and securing the pontoon with a retainer attached to the end of said arm.

3. A pontoon for mounting to a canoe having an outrigger arm as defined in claim 2 wherein each said arm passes through said pontoon horizontally and parallel to the water near each end and a clamping device attached to the upper arm of each outrigger so that both the rotation of the clamps in relation to the pivot point and the adjustment of height in the outrigger arms allow for mounting the pontoon to canoes of various lengths and depths.

* * * * *